US007679291B2

(12) United States Patent
Jones et al.

(10) Patent No.: US 7,679,291 B2
(45) Date of Patent: Mar. 16, 2010

(54) BARRICADE FLASHER

(75) Inventors: Philip Jones, Hendon (AU); John Sidney Crawford, Hendon (AU)

(73) Assignee: Integrated Electronic Solutions Pty Ltd. (AU)

( * ) Notice: Subject to any disclaimer, the term of this patent is extended or adjusted under 35 U.S.C. 154(b) by 929 days.

(21) Appl. No.: 10/544,901

(22) PCT Filed: Feb. 25, 2004

(86) PCT No.: PCT/AU2004/000232

§ 371 (c)(1),
(2), (4) Date: Jun. 12, 2006

(87) PCT Pub. No.: WO2004/076916

PCT Pub. Date: Sep. 10, 2004

(65) Prior Publication Data

US 2006/0267797 A1 Nov. 30, 2006

(30) Foreign Application Priority Data

Feb. 25, 2003 (AU) ..... 2003900823

(51) Int. Cl.
*H05B 37/00* (2006.01)

(52) U.S. Cl. ..... 315/200 A

(58) Field of Classification Search ..... 315/200 A, 315/209 R, 210–211, 215–216, 217, 291, 315/214

See application file for complete search history.

(56) References Cited

U.S. PATENT DOCUMENTS 4,168,427 A 9/1979 Hubbard
4,229,664 A 10/1980 Blake et al.
4,323,879 A * 4/1982 Kelley ..... 340/321
4,564,756 A 1/1986 Johnson
5,005,004 A * 4/1991 Udofot ..... 340/600
5,072,210 A * 12/1991 Kimmelman ..... 340/458
5,294,924 A 3/1994 Dydzyk
5,313,187 A * 5/1994 Choi et al. ..... 340/331
5,313,188 A * 5/1994 Choi et al. ..... 340/331
RE34,847 E * 2/1995 Muderlak et al. ..... 222/25
5,469,157 A 11/1995 Carpenter et al.
5,541,704 A 7/1996 Dunsmore
5,664,874 A 9/1997 Winterer
6,086,220 A 7/2000 Lash et al.
6,255,804 B1 * 7/2001 Herniter et al. ..... 320/137
7,354,770 B2 * 4/2008 Huebner et al. ..... 436/147

FOREIGN PATENT DOCUMENTS

DE 24 06 266 A1 8/1975
JP 2000-319833 A 11/2000

* cited by examiner

*Primary Examiner*—Douglas W Owens
*Assistant Examiner*—Minh D A
(74) *Attorney, Agent, or Firm*—Akerman Senterfitt

(57) ABSTRACT

A flashing warning light apparatus wherein there is provided one or more light-emitting diodes, the light-emitting diode being driven in a pulsed manner to achieve light output at a selected flash rate, with control means adapted to detect any light-induced signal from the same light-emitting diode or diodes during periods when the light-emitting diode is not emitting light, said signal being dependent on the level of ambient light. The same diode or diodes can be at a focus center of a reflector. A magnitude of any signal can then be used to determine whether the ambient light is such that the warning light should operate.

17 Claims, 1 Drawing Sheet

BARRICADE FLASHER

This application is a 371 National Phase of PCT/AU2004/000232, filed Feb. 25, 2004, which claims the benefit of Australian Patent Application No. 003900823, filed Feb. 25, 2003.

TECHNICAL FIELD

This invention relates to a method and means relating to flashing warning lights to operate in darkness particularly where there is included ambient light detection.

BACKGROUND ART

Integrated circuits which use the light sensing properties of a silicon junction to detect the ambient light and to switch a flashing incandescent lamp powered from a battery power supply in accordance with the ambient light level are known. Integrated circuits incorporating such a junction, along with circuitry to intermittently power the lamp while a given level of ambient light is detected are available. External to the chip, networks of resistors and capacitors provide necessary time constants to control the flash rate of the light. These RC time constants set the ON and OFF time period of each flash cycle.

Later developments incorporated the timing circuits into the chip using an internal oscillator, compensated for temperature and component spreads, with a digital frequency divider to offer the required output period and frequency.

It has been found that ambient light generates leakage currents in reverse biased junctions (and photo-voltaic voltages in a unbiased junctions), so the design of these integrated circuits has needed to take into account the inherent characteristics of the silicon circuit and by appropriate layout or other means, to ensure that any incident light does not produce unexpected light induced signals and cause the circuit to exhibit unintended behaviour.

Known barricade warning lamps have a light source placed at the focus of on optical system adapted to condition the light output into a beam with desired directional characteristics. This system may include focusing lenses and reflectors.

While a light source occupies the central position at the focus of the lens system for these known barricade warning lamps, it has been found that the optimum position for the location of a light sensor is also near to this focus to offer a best sensitivity to ambient light. Of course it is better to isolate the sensor from the light source, to prevent the light from the lamp disrupting the detection of the ambient light. This gives rise, however, to the problem that the sensor and the light source would then need to occupy the same space but be visually isolated from each other.

A further problem is that it is expensive to encapsulate a control integrated circuit in a manner that also allows it to sense the ambient light, or alternatively to provide a diode or light sensitive transistor in a separate transparent package.

It is also known to have a lamp operate in a continuous mode in which the lamp is on apparently continuously at any time the light sensor registers darkness. If light is detected the lamp is turned off to check on the true ambient light level, and if it is found to be still dark (the detected light having been being the lamp light falling on the sensing area) the lamp is immediately switched back on, the process repeating at short intervals. While this does involve a brief break in the lamp illumination, in practice it can be so brief as to not be noticeable.

Recent developments in light emitting diode technology has enabled a filament lamp to be replaced by light-emitting diodes. With a barricade flasher then which has an output directed in two oppositely directed paths there can be one diode at each focus of the plastic lenses of the lamp. Each light-emitting diode is directed in the direction of the beam of the lens, giving a pair of light-emitting diodes mounted in opposing directions back to back at the focus of the lamp lenses.

It is an object of this invention to provide means to overcome one or more of the disadvantages of the prior art, or at least to provide the public with a useful alternative.

DISCLOSURE OF THE INVENTION

A light-emitting diode is, of course, a semi-conducting junction. When it is not being driven to emit light, a light-emitting diode has the same problems of unwanted light induced signals (leakage currents and photo-voltaic voltages) as described above. However by in fact using this previously considered disadvantage we have provided an effective and very cost efficient solution.

My discovery is that these light induced signals, rather than being a problem, can be used to provide a signal indicative of the level of ambient light.

In one form of the invention, it may be said to reside in a flashing warning light apparatus including at least one light-emitting diode, a limited capacity power source, means adapted to effect the selective energisation of the at least one light-emitting diode to effect a light output from time to time, means adapted to detect any light induced electrical signal from the at least one light-emitting diode in at least one period when said diode is not energized, and means to change at least the extent of energization of the at least one light-emitting diode in response to a selected level of light induced electrical signal being detected in at least one period when said diode is not energized.

In a further form of the invention there is provided a flashing warning light apparatus wherein there is provided one or more light-emitting diodes, driver means adapted to drive said light-emitting diode in a pulsed manner to achieve light output at a selected flash rate, and control means adapted to detect a light induced signal from the light-emitting diode during periods when the light-emitting diode is not emitting light, said signal being dependent on the level of ambient light.

In preference, the control means is adapted to inhibit the pulsed drive to the light-emitting diode when the light induced signal is above a selected level.

In preference, the driver means is adapted to drive the light-emitting diode in such a manner that the light output is apparently continuous, with periodic interruptions to the light-emitting diode drive, such interruptions being sufficiently brief that the interruption to the light-emitting diode light output is not visibly noticeable to an observer and the control means being adapted to detect any light induced signal from the light-emitting diode during such periodic interruptions.

In preference, at least one light-emitting diode is located approximately at the focal point of one or more lenses, said lenses being adapted to disperse light from the light-emitting diode when such diode is energized, and to focus ambient light on to said diode when the diode is not energized.

In preference the driver means and the control means are constructed using discrete components or combinations of integrated circuits.

In preference, in the alternative, the control means and the driver means are constructed as an integrated circuit which includes all the electronic circuit functions in one chip of silicon.

In preference the integrated circuit or discrete component circuit are on a printed circuit board (PCB), mounted away from the ambient light with the light-emitting diode being mounted remotely from this PCB at an appropriate location for light emission and detection.

In preference the said two or more light-emitting diodes are electrically connected in series.

In preference in the alternative the two or more light-emitting diodes are electrically connected in parallel.

In preference the control means are adapted to operate by detecting a photo-voltaic voltage generated by a light-emitting diode when this is illuminated by the ambient light.

In preference the control means operates by detecting light induced current flowing through a one or more light-emitting diode when illuminated by the ambient light.

In a further form, the invention may be said to reside in a method for effecting an ambient light responsive light source including the selective energization of at least one light-emitting diode to effect a light output from time to time, detection of any light induced electrical signal from the at least one light-emitting diode in at least one period when it is not energized to effect a light output, changing at least the extent of energization of the at least one light-emitting diode in response to a selected level of light being detected in at least one period when it is not energized to effect a light output.

In preference, in the alternative, the light output may be effected almost continuously, with the intervals when the light-emitting diode is not energized being sufficiently brief that the interruption to the light-emitting diode light output is not visibly noticeable to an observer.

In a further form, there is provided a focusing reflector, a light emitting diode at a focus area of the reflector, and means to effect a light output from the light emitting diode from time to time and further characterised in that where, during at least some of the time that the light emitting diode is not emitting light it is interrogated such that an output signal will be detectable as a result of a selected level of ambient light being detected as a result of such light being focused from the reflector onto the light emitting diode.

In a further form, the invention may be said to reside in a method of effecting a flashing warning light wherein there is a focusing reflector, a light emitting diode at a focus area of the reflector, and means to effect a light output from the light emitting diode from time to time and further characterised in that where, during at least some of the time that the light emitting diode is not emitting light it is interrogated such that an output signal will be detectable as a result of a selected level of ambient light being detected as a result of such light being focused from the reflector onto the light emitting diode, the method including the steps of changing the extent of energisation of the light emitting diode in response to an amount light detected during a detection period.

BRIEF DESCRIPTION OF THE DRAWINGS

For a better understanding of this invention it will now be described in relation to an embodiment which shall now be described with the assistance of drawings wherein.

BEST MODE FOR CARRYING OUT THE INVENTION

Figure 1:
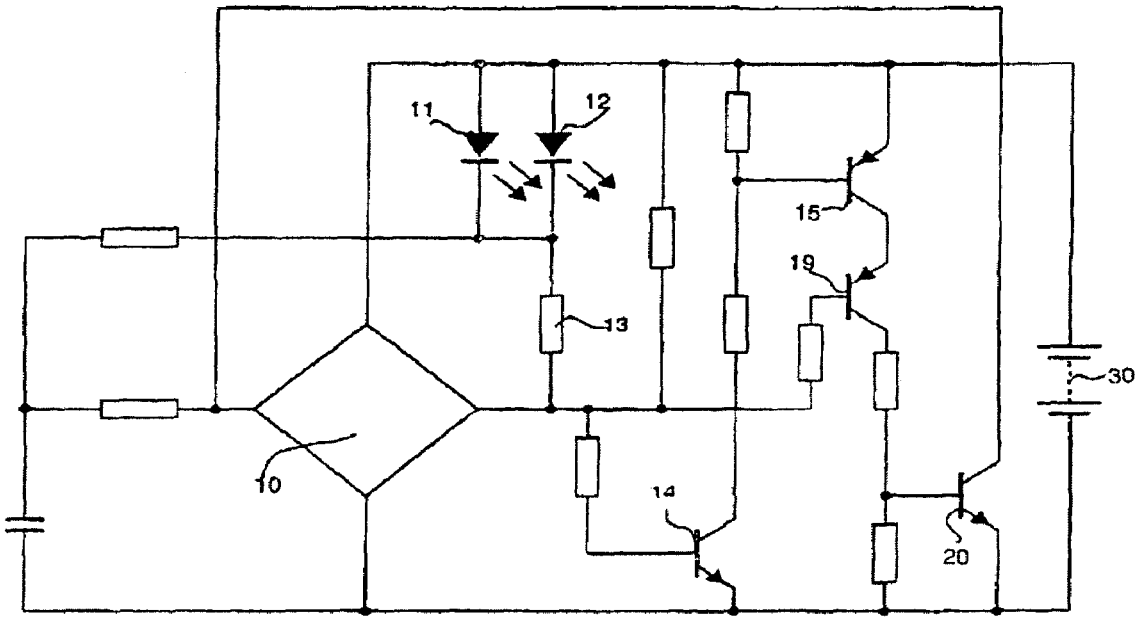
FIG. 1 is a circuit drawing with the embodiment using discrete components for the purpose of operating a road side barricade flasher.

Referring to the drawing, there is an Integrated circuit 10 (IC) which provides a pulsed drive to each of light-emitting diodes 11 and 12. This IC is not light sensitive. Light-emitting diodes 11 and 12 provide both a light output and act as the sensors for ambient light.

The resistor 13 limits the current flowing into the light-emitting diodes. Power is supplied by the battery 30.

While the output drive to the light-emitting diodes is on, transistor 14 is turned OFF, turning OFF transistor 15, and therefore transistors 19 and 20.

When the IC 10 output drive is OFF, the resistor 13 pulls the voltage across the light-emitting diodes 11 and 12 towards the positive supply rail. Therefore transistor 19 is held off, and although transistor 15 is ON, with transistor 19 OFF there is no collector current to drive transistor 20 and turn it ON. However, if there is incident light on the light-emitting diodes 11 and 12 of a sufficient brightness to generate a photovoltaic voltage of sufficient magnitude to turn on transistor 19, then transistor 20 will be turned on, with its collector holding the input pin of IC 10 low, and preventing the voltage rising to the threshold to generate the next flash.

Since there is no requirement for the control circuit to include a light detection capacity, the integrated circuit can be housed in a mass produced black epoxy package, either in the industry standard dual-in-line (DIL) package, or in the small outline (SO) package.

Once housed in black plastic there is no longer any need for the control circuit to be designed to be insensitive to incident light to prevent untoward behaviour in the way that is necessary when the light detector is incorporated as part of the control circuit and it is housed in clear plastic.

Since the sensor is in fact the same component (the light-emitting diodes) as the light source, they are inherently located in the same physical space, which location can be optimised to be the focus of a lens or reflector system, and are "isolated" from each other by the time sequence of use, so that no physical separation is required.

Although the invention has been herein shown and described in what is conceived to be the most practical and preferred embodiment, it is recognised that departures can be made within the scope of the invention, which is not to be limited to the details described herein but is to be accorded the full scope of the appended claims so as to embrace any and all equivalent devices and apparatus.

The invention claimed is:

1. A flashing warning light apparatus including:

at least one light-emitting diode located approximately at a focal point of one or more lenses, said lenses being adapted to disperse light from the light-emitting diode when the light-emitting diode is energized, and said lenses being adapted to focus ambient light on to the light-emitting diode when the light-emitting diode is not energized, a limited capacity power source, an integrated circuit (IC) adapted to selectively energize at least one light-emitting diode to effect a light output during at least one first time period, and at least one transistor adapted to detect a light-induced electrical signal generated by the at least one light-emitting diode due to ambient light focused on to the light-emitting diode in at least one second time period when said diode is not energized, wherein the light-induced electrical signal is provided to the IC by the at least one transistor, and wherein the IC is adapted to change at least the extent of energization of the at least one light-emitting diode in response to a selected level of light induced-electrical signal being detected in at least one period when said diode is not energized.

2. A flashing warning light apparatus comprising;

one or more light-emitting diodes located approximately at a focal point of one or more lenses, said lenses being adapted to disperse light from the light-emitting diode when the light-emitting diode is energized, and said lenses being adapted to focus ambient light on to the light-emitting diode when the light-emitting diode is not energized, a driver component to drive at least one of said light-emitting diode in a pulsed manner to achieve light output at a selected flash rate, and a controller adapted to detect a light-induced signal from the said at least one light emitting diode during periods when the light-emitting diode is not emitting light, said signal being dependent on the level of ambient light focused on to the light emitted diode.

3. The flashing warning light apparatus as in claim 2 wherein the controller is adapted to inhibit the pulsed drive to the light-emitting diode when the light induced signal is above a selected level.

4. The flashing warning light apparatus as in claim 2 wherein the driver component is adapted to drive said at least one light-emitting diode at a selected flash rate such that the light output emitted by said at least one light-emitting diode is apparently continuous to an observer, with periodic interruptions to the light output of the light-emitting diode that are sufficiently brief that the pulsed manner of the light-emitting diode light output is not visibly noticeable to an observer and wherein the controller is adapted to detect any light-induced signal from the light-emitting diode during said brief periodic interruptions.

5. The flashing warning light apparatus as in claim 2 wherein the driver component and the controller are constructed using discrete components or combinations of integrated circuits.

6. The flashing warning light apparatus as in claim 2 wherein the controller and the driver component are constructed as an integrated circuit which includes all the electronic circuit functions in one chip of silicon.

7. The flashing warning light apparatus as in claim 2 wherein the integrated circuit or discrete component circuit is assembled on a printed circuit board (PCB) mounted away from the ambient light, and wherein the light-emitting diode is mounted remotely from said PCB at a convenient point for light emission and detection.

8. The flashing warning light apparatus as in claim 2 wherein two or more light-emitting diodes are provided, electrically connected in series.

9. The flashing warning light apparatus as in claim 2 wherein two or more light-emitting diodes are provided, electrically connected in parallel.

10. The flashing warning light apparatus as in claim 2 wherein the controller operates by detecting the photo-voltaic voltage generated by the light-emitting diode when illuminated by the ambient light.

11. The flashing warning light apparatus as in claim 2 wherein the controller operates by detecting the light induced current flowing through the light-emitting diode when illuminated by the ambient light.

12. The flashing warning light apparatus as in claim 2 wherein the apparatus is a barricade flasher.

13. A flashing warning light apparatus comprising:

a focusing reflector, a light emitting diode located approximately at a focus area of the reflector, said focusing reflector being adapted to disperse light from the light-emitting diode when the light-emitting diode is energized, and said focusing reflector being adapted to focus ambient light on to the light-emitting diode when the light-emitting diode is not energized, and an integrated circuit to effect a light output from the light emitting diode during at least one first time period, wherein, during at least one second time period when the light emitting diode is not emitting light, the light emitting diode is interrogated to detect an output signal generated by the light emitting diode as a result of a selected level of ambient light-focused from the reflector onto the light emitting diode, wherein a magnitude of the output signal corresponds to the selected level of ambient light, and an extent of energization of the light emitting diode is changed in response to the magnitude of the detected output signal.

14. The flashing warning light apparatus as in claim 13 where the apparatus is a portable apparatus with a battery for supply of electrical energy.

15. A method for effecting an ambient light responsive light source including: selectively energizing at least one light-emitting diode to effect a light output during at least one first time period, detecting a light-induced electrical signal generated by the at least one light-emitting diode from ambient light focused on to the light-emitting diode in at least one second time period when the light-emitting diode is not energized to effect a light output, and changing at least an extent of energization of the at least one light-emitting diode in response to a selected level of ambient light being detected by the light-emitting diode in at least one period when it is not energized to effect a light output.

16. The method of claim 15 wherein the intervals when the light-emitting diode is not energized are sufficiently brief that the interruption to the light-emitting diode light output is not visibly noticeable to an observer.

17. A method of effecting a flashing warning light including a focusing reflector, a light emitting diode located at a focus area of the reflector, and an integrated circuit to effect a light output from the light emitting diode during at least one first time period, the method including the steps of:

during at least one second time period when the light emitting diode is not emitting light, interrogating the light emitting diode to detect an output signal generated by the light emitting diode as a result of a selected level of ambient light focused from the reflector onto the light emitting diode, wherein a magnitude of the output signal corresponds to the selected level of ambient light, and changing an extent of energization of the light emitting diode in response to the magnitude of the detected output signal during a detection period.

* * * * *